US006854908B2

(12) United States Patent
Hui et al.

(10) Patent No.: US 6,854,908 B2
(45) Date of Patent: Feb. 15, 2005

(54) APPLICATOR FOR AN ARC-SHAPED COMPOSITION STICK

(75) Inventors: Ron C. Y. Hui, Burnaby (CA); Jonathan deWet, North Vancouver (CA); Chris Dale, Kensington (AU); Malcolm Curtis, North Vancouver (CA)

(73) Assignee: Kelsan Technologies Corp., British Columbia (CA)

( * ) Notice: Subject to any disclaimer, the term of this patent is extended or adjusted under 35 U.S.C. 154(b) by 0 days.

(21) Appl. No.: 10/389,387

(22) Filed: Mar. 14, 2003

(65) Prior Publication Data

US 2004/0179887 A1 Sep. 16, 2004

(51) Int. Cl.[7] ..... A45D 40/10; B43K 21/14; B61K 3/00

(52) U.S. Cl. ..... 401/81; 401/55; 401/57; 184/3.1; 184/3.2

(58) Field of Search ..... 401/55, 57, 58, 401/90, 81, 87, 99; 305/117; 184/3.1, 3.2, 21

(56) References Cited

U.S. PATENT DOCUMENTS 3,994,605 A * 11/1976 McKnight ..... 401/99
4,227,823 A * 10/1980 Kitzerow ..... 401/99
5,337,860 A * 8/1994 Burke et al. ..... 184/3.2
6,136,757 A 10/2000 Chiddick ..... 508/126

* cited by examiner

*Primary Examiner*—David J. Walczak
(74) *Attorney, Agent, or Firm*—Needle & Rosenberg, P.C.

(57) ABSTRACT

An applicator for a circular arc-shaped solid composition comprises a housing defining a conduit that is sized to accept the circular arc-shaped solid composition stick. The conduit has a first end and a second end, the second end being open, and has a continuous circular arc-shape from the first end to the second end. The housing also contains one, or more than one opening for engaging a fastener. Each one of the one, or more than one opening is of a sufficient size to permit at least partial lateral movement of the fastener. Also included in the housing are an inlet and an outlet in communication with the conduit, the outlet being in communication with the second end, and a biasing assembly for advancing the circular arc-shaped solid composition stick within the conduit. The position of the applicator of the present invention relative to a surface to be treated can be easily adjusted by laterally sliding the housing of the applicator relative to its mounting bracket.

29 Claims, 15 Drawing Sheets

APPLICATOR FOR AN ARC-SHAPED COMPOSITION STICK

The present invention relates to an applicator for housing a solid composition stick. More particularly, the present invention relates to an applicator for an arc-shaped solid composition stick.

BACKGROUND OF THE INVENTION

Systems are known for lubricating or otherwise modifying the coefficient of friction between steel surfaces in sliding contact, for example, the flanges of rail car wheels and a track, or fifth-wheels. One type of system uses a liquid lubricant, such as oil or grease, to lubricate the flanges of the rail car wheels. A problem associated with these liquid lubrication systems, however, is the inability to meter the amount of the liquid lubricant applied in a controlled manner. This lack of control may result in the application of an excess amount of liquid lubricant to the flanges of the rail car wheels causing some of the lubricant to runoff onto the tread portion of the rail car wheels. The lubricant on the tread portion of the wheels can then coat the top of the rail and result in appreciable slippage of the rail car wheels on the rail. In addition, if the liquid lubricant is applied at too high a flow rate it may be flung from the wheel to beneath the rail car, and result in contamination of the environment.

In attempting to overcome the above problems experienced with liquid lubrication systems, solid lubricant or friction modifier compositions in the form of sticks, for example U.S. Pat. No. 6,136,757 (which is incorporated herein by reference), have been used to apply compositions to the flanges of rail car wheels. As these solid sticks are usually made of hard, brittle materials, applicators for use with these sticks have been developed, which are capable of withstanding the severe vibration and shock conditions experienced during operation. Applicators having a rectangular conduit for accommodating a rectangular shaped lubricant stick have been used to apply lubricant to the flange of rail car wheels. These applicators are, however, difficult to reload, and can only accommodate sufficient lubricant material for short duration transit systems, or for closed track systems.

An alternate applicator for use with a solid composition utilizes an arc-shaped solid composition stick produced by Kelsan Technologies Corporation. This applicator, is circular in shape, and houses a one-piece, arc-shaped, composition stick. This type of applicator is suitable for both closed and open rail systems as the length of the stick is greater than the rectangular sticks mentioned above, and the useable life of the composition stick is increased. Upon completion of the composition stick, the entire applicator is discarded. To simplify attaching and removing the circular applicator, a centrally located fastening point is used to connect the applicator to the undercarriage of a rail car. However, the central attachment point reduces the extent of repositioning of the applicator relative to the flange of the rail car wheel, and may also allow increased vibration of the applicator while in use, resulting in damage to the composition stick.

A robust applicator, characterized as exhibiting an increased duration period between refills along with an increased ease of refilling, capable of minimizing vibrational effects on a solid composition stick housed within, and that can be adjusted to properly interface with a desired steel surface for treatment, is required.

It is an object of the invention to overcome disadvantages of the prior art.

The combinations of features of the main claims meet the above object. The sub-claims disclose further advantageous embodiments of the invention.

SUMMARY OF THE INVENTION

The present invention relates to an applicator for a solid composition stick. More particularly, the present invention relates to an applicator for an arc-shaped solid composition stick.

The present invention provides an applicator for an arc-shaped composition stick, comprising:

a housing defining an arc-shaped conduit, the arc-shaped conduit sized to accept the arc-shaped solid composition stick, the housing comprising:

one, or more than one opening for engaging a fastener, the one, or more than one opening being of a sufficient size to permit at least partial lateral movement of the fastener;

an inlet and an outlet, the inlet and the outlet in communication with the conduit, and a biasing assembly for advancing the arc-shaped solid composition stick within the arc-shaped conduit.

Furthermore, the housing of the applicator may further comprise one, or more than one radially extending rib. The applicator may also include the arc-shaped solid composition stick.

The housing of the applicator defined above may be fabricated from a polymer having a suitable tensile strength, or compression strength. Non-limiting examples of a polymer include high density polyethylene (HDPE), or Nylon®. Alternatively, the housing may be fabricated from aluminum, steel or fiber reinforced plastic (FRP).

The present invention also pertains to the applicator defined above, wherein the biasing assembly comprises a spring assembly for biasing a contact member against the arc-shaped solid composition stick, the contact member connected to the spring assembly. Furthermore, the contact member may be a contact stick, where the contact stick is in operative association with the spring assembly, and pivotally connected to the applicator housing, the contact stick moveable through an area contained within the arc-shaped conduit.

The present invention also provides the applicator defined above, wherein the housing comprises an upper and a lower section, the upper, lower, or both upper and lower section comprising one, or more than one opening for inserting a fastener for installing the applicator while in use, the one, or more than one opening being of a sufficient size to permit at least partial lateral movement of the fastener within the opening.

This invention is also directed to the applicator as defined above, that comprises one or more than one attachment plate attached to the upper, lower, or both the upper and lower housing. Furthermore, the applicator may comprise one or more than one bracket attached to the upper, lower, or both the upper and lower housing.

The present invention also provides an applicator for an arc-shaped solid composition stick, comprising:

a housing, the housing defining an arc-shaped conduit for the arc-shaped composition stick, the housing comprising:

an upper and a lower section, the upper section, the lower section, or both the upper and lower sections comprising one, or more than one opening for engaging a fastener, the one, or more than one opening being of a sufficient size to permit at least partial lateral movement of the fastener, the upper section, the lower section or both the upper and lower sections further comprising one, or more than one radially extending rib;

a biasing assembly for advancing the arc-shaped solid composition stick within the arc-shaped conduit, the biasing assembly comprising a spring assembly and a contact stick, the spring assembly biasing the contact stick against the arc-shaped solid composition stick, the contact stick pivotally connected to the housing, and moveable through an area contained within the arc-shaped conduit, and an inlet and an outlet, the inlet and the outlet in communication with the arc-shaped conduit.

The applicator of the present invention is stronger and more rigid than prior art applicators for arc-shaped solid composition sticks. The improved rigidity reduces fatigue and vibrations that reduce wear on the applicator and the mounting used to connect the housing of the applicator to the undercarriage of a rail car, and increases the vibrational stability of the applicator, compared to prior art applicators.

Another advantage of the applicator of the present invention is that the position of the applicator relative to the surface to be treated, for example but not limited to a flange of a rail car wheel, or a fifth wheel, or an elevator track, can be easily adjusted by laterally sliding the housing of the applicator relative to its mounting bracket.

Furthermore, the applicator as described herein may be easily refilled, and does not need to be disposable. The applicator may be refilled by inserting one, or more than one arc-shaped composition stick through the outlet of the conduit. The process of refilling does not require disassembly of the applicator housing. By increasing the length of the arc-shaped conduit, more composition sticks can be introduced into the applicator per loading, thereby reducing the frequency of refilling the applicator. Utilization of the composition stick may also be readily observed by visual inspection of advancement of the mechanism that advances the composition stick through the conduit, or visual inspection of the conduit.

BRIEF DESCRIPTION OF THE DRAWINGS

These and other features of the invention will become more apparent from the following description in which reference is made to the appended drawings wherein:

FIG. 1 shows a prior art applicator for an arc-shaped lubricant stick.

DETAILED DESCRIPTION OF PREFERRED EMBODIMENTS

The present invention relates to an applicator for a solid composition stick. More particularly, the present invention relates to an applicator for an arc-shaped solid composition stick.

The following description is of a preferred embodiment by way of example only and without limitation to the combination of features necessary for carrying the invention into effect.

Figure 1A:
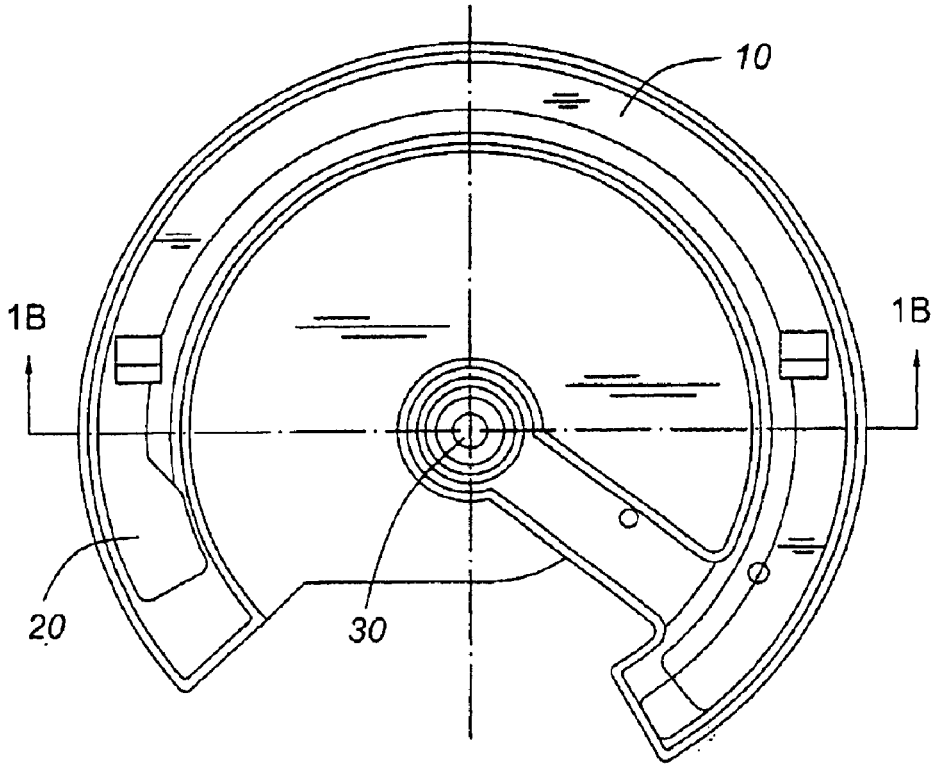
FIG. 1A Prior Art
FIG. 1A shows a top view of the prior art applicator.
Figure 1B:
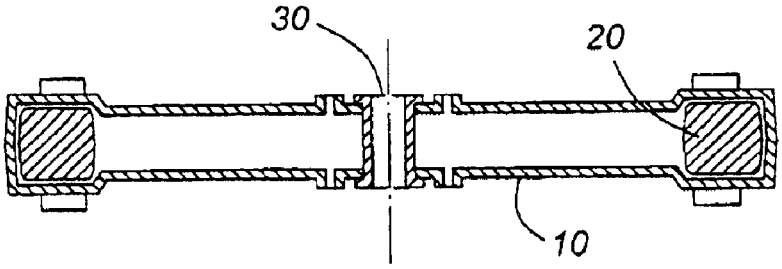
FIG. 1B Prior Art
FIG. 1B shows a sectional view of the prior art applicator at line 1B—1B.

FIG. 1 shows a prior art circular applicator (10). While effective in extending the duration of use of a composition stick (20) under field conditions, the applicator is disposable and it is replaced after completion of the stick. The composition stick is made of one piece, and is not readily inserted within the applicator when mounted on a vehicle. Refilling the applicator requires disassembly. The applicator is attached by a central fastening point (30) to permit rapid replacement of the applicator, however, this method of attachment permits the outer periphery of the applicator to vibrate while in use leading to fracturing of the composition stick.

Figure 2:
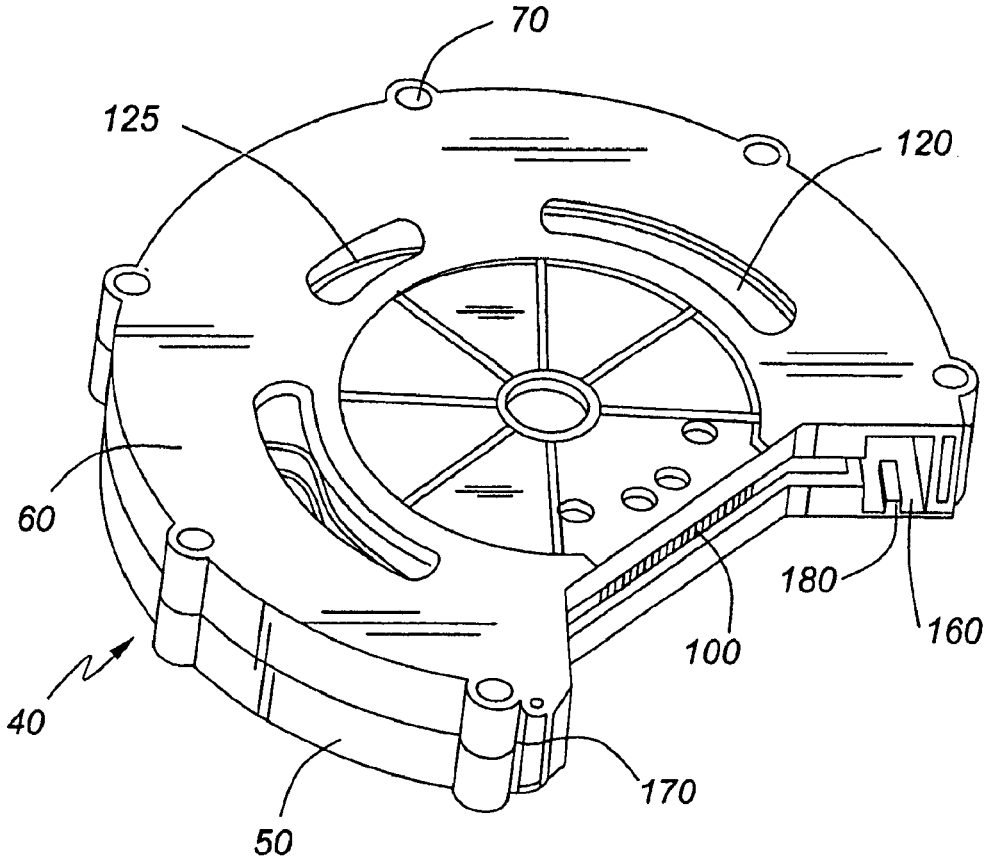
FIG. 2 shows a perspective view of an example of the applicator of the present invention.
Figure 13:
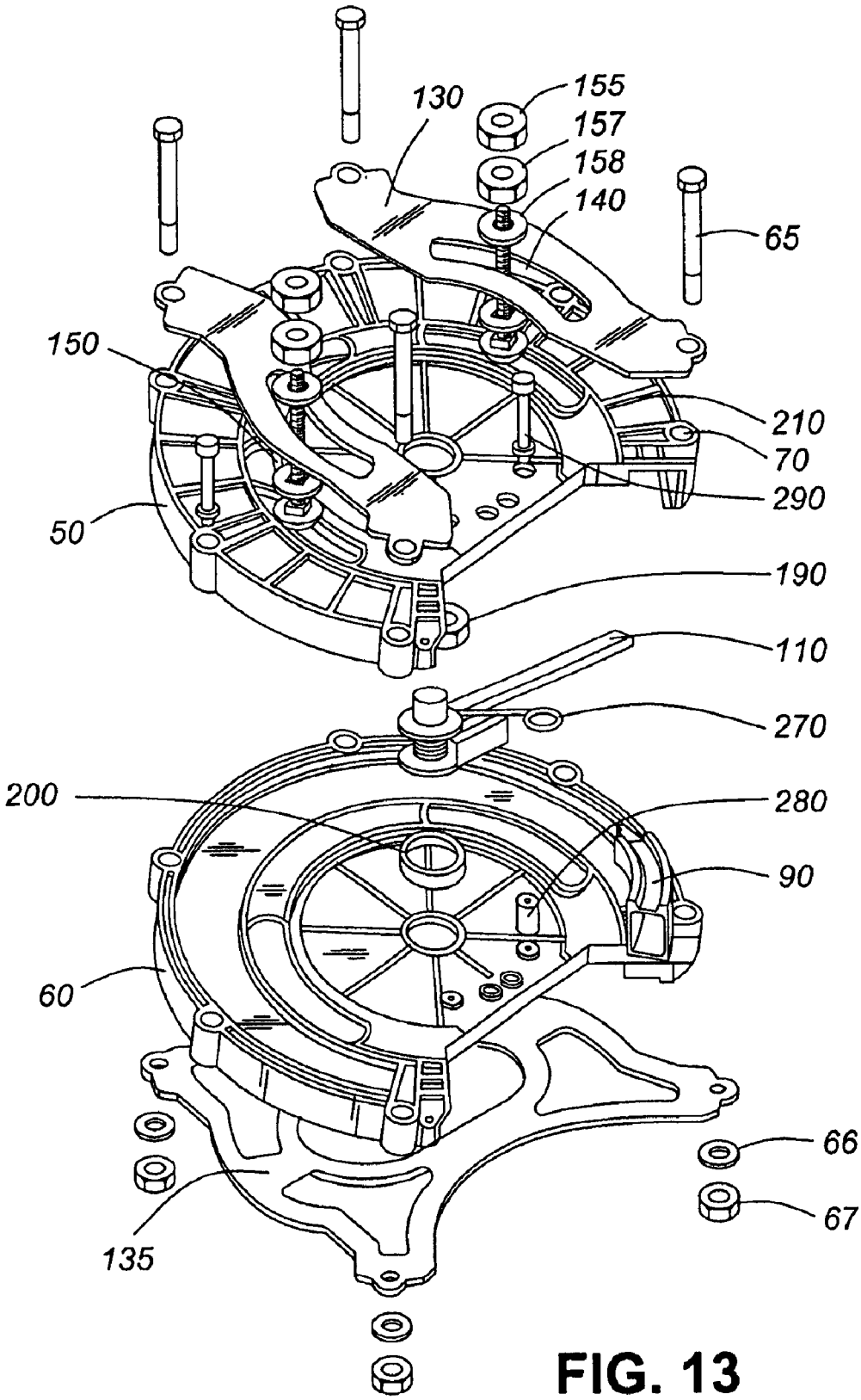
FIG. 13 shows an exploded view of the applicator of FIG. 11A.
Figure 14:
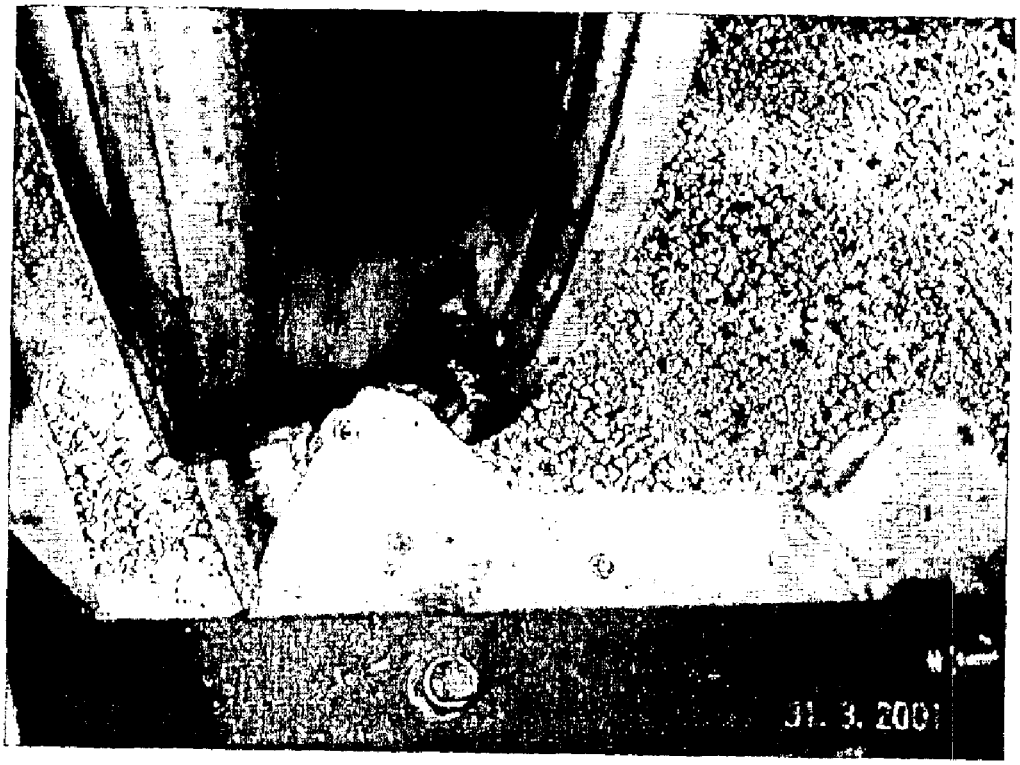
FIG. 14 shows an applicator of the present invention mounted to a bracket and positioned so that a composition stick interfaces with a flange of a rail car wheel.
Figure 13:
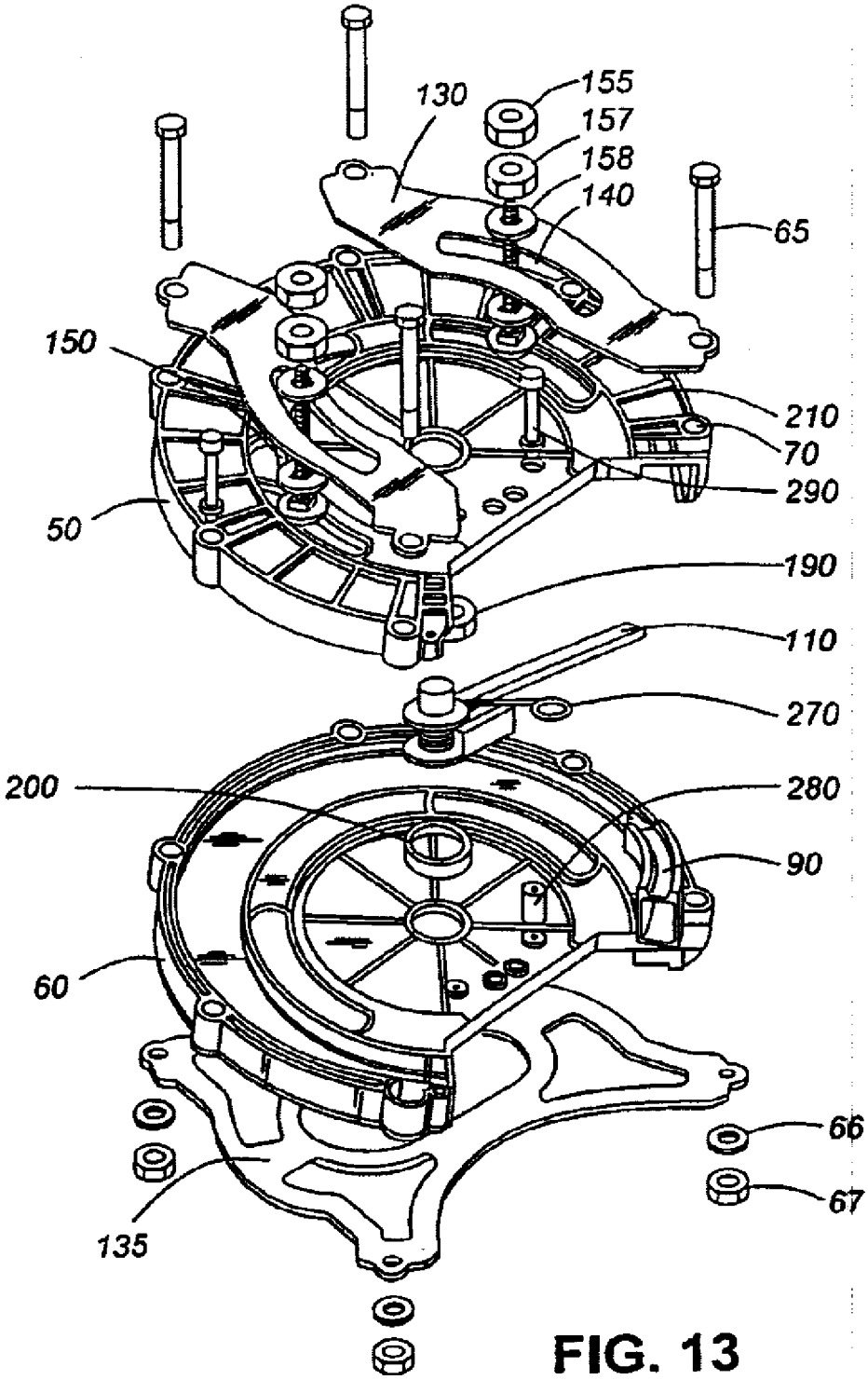

Referring to FIG. 2, there is shown an example of the applicator (40) of the present invention comprising a upper section (50) and a lower section (60). The upper and lower sections (50, 60) are connected by a series of fasteners (65, FIGS. 4 and 13) inserted through openings (70). Each fastener (65) is secured in place using a suitable retainer, such as nut (67), together with washer (66), as shown in FIG. 13. When connected, the top and bottom sections (50, 60) define two contiguous openings: an arc-shaped conduit (80; see FIG. 4) for accommodating an arc-shaped composition stick (90; FIGS. 3A–F), and a passageway (100) in communication with the conduit (80). However, the applicator may be made up of a one piece housing comprising both the upper and lower sections.

Figure 4:
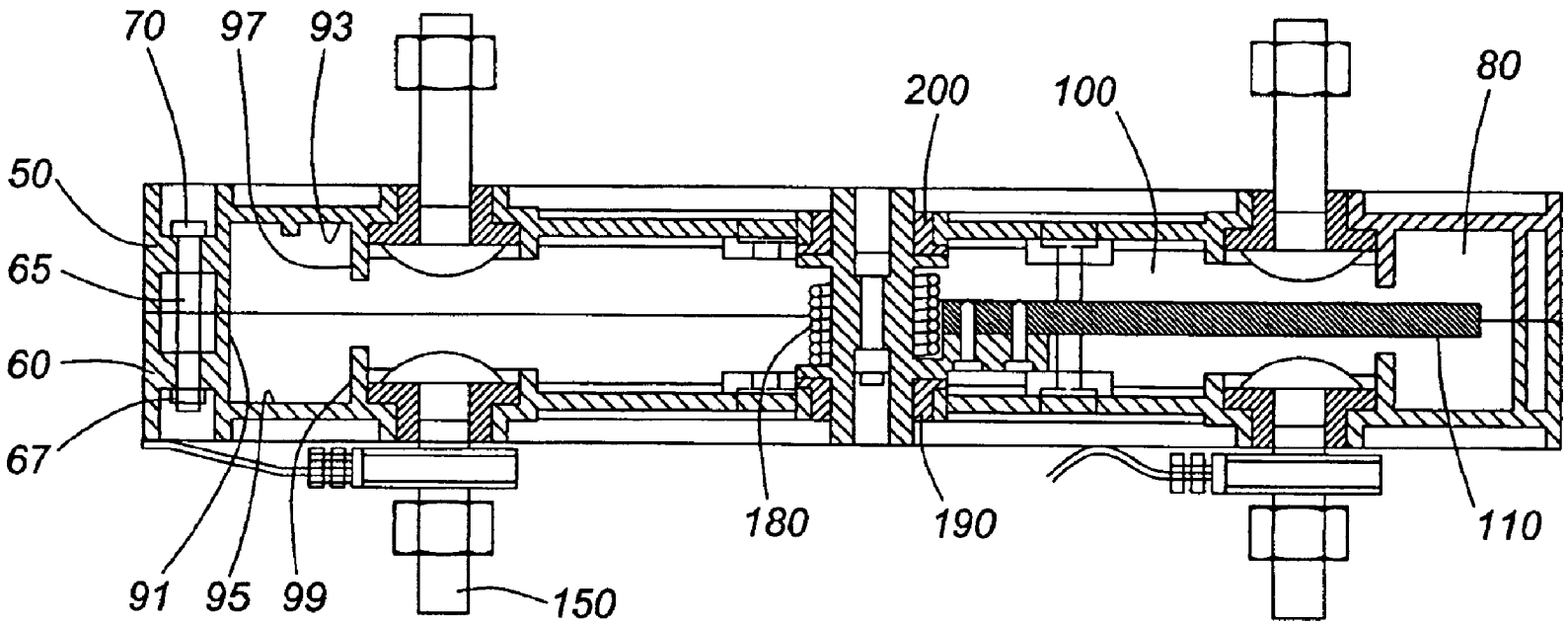
FIG. 4 shows a cross-sectional view along line 4—4 in FIG. 3A.

With reference to FIG. 4, the arc-shaped conduit (80) comprises a continuous outer wall (91), a continuous top wall (93), a continuous bottom wall (95), a flange extending from the inner edge of the top wall (97) and a flange extending from the inner edge of the bottom wall (99).

The applicator of the present invention can be used with a single arc-shaped composition stick, or with a set of one, or more than one interlocking arc-shaped composition stick. Non-limiting examples of the composition stick, and the set of interlocking composition sticks for use with the applicator of the present invention are shown in FIGS. 3C–F and FIG. 3B, respectively. The arc-shaped composition stick is preferably an arc-shaped solid composition stick. The composition stick (90) is shown to have a rectangular cross section, however, other cross sectional shapes may also be used, including but not limited to, circular, elliptical, rectangular, or triangular. The conduit of the applicator of the present invention can be easily modified to accommodate composition sticks of different cross-sectional areas and shapes. The composition stick may be of any desired length. The example shown in FIG. 3B comprises a set of composition sticks, where each stick has a length that is approximately $1/6^{th}$ the length of the conduit (80). However, other lengths may be used. Advantages of using a set of interlocking sticks instead of a single long stick includes the ability to refill the applicator before it becomes completely empty, and the ease with which the applicator can be refilled. Furthermore, the interlocking feature provides support to a segment of a set of interlocking sticks, which is in contact with a surface, such as a wheel flange, and prevents it from falling out of the applicator and contaminating the environment once it is worn down to a short length. This interlocking feature is therefore also advantageous from an economic standpoint as individual segments of the set of interlocking, segmented sticks may be used to completion. A single arc-shaped composition stick may require disassembly of the housing for replacement. However, this is not always the case, as it depends on the length of the composition stick and the size of the opening defined between the inlet (160) and the outlet (170). Utilization of the composition stick within the applicator may also be readily observed by visual inspection of the mechanism (see below) that advances the composition stick through the conduit, or visual inspection of the conduit.

The composition stick for use in the applicator of the present invention may be formed of one of the compositions disclosed in U.S. Pat. No. 6,136,757, the disclosure of which is incorporated herein by reference.

The following description will relate to an applicator that is used with segmented, interlocking, or inter-fitting solid composition sticks, as illustrated in FIGS. 2, 3A, and 4–14. It is to be understood, however, that the applicator (40) of the present invention can be used with an arc-shaped solid composition stick of any length, or cross-sectional shape, which has an arc that is complementary to that of the arc-shaped conduit (80) defined by the housing. As described above, the composition sticks may comprise features that permit their fitting together, for example a male end and a corresponding female receiving end. However, such ends are not required, and any end, including a flat surface, may be used on a composition stick.

The applicator of the present invention may include a rubber seal or a brush seal, for example, which is not to be considered limiting, made of nylon or other flexible material, to seal the opening that leads to passageway (100) to prevent dirt and oil from entering into the applicator housing (40), yet allowing movement of a contact stick (110) through passageway (100).

The applicator housing (40) comprises several attachment openings (120, 125) that can be accessed for attaching the applicator (40) to a mounting bracket (not shown) when in use. The applicator may be attached to the mounting bracket through one, or more than one reinforcement plate (130; see FIG. 6) also comprising an arc-shaped opening (140). The reinforcement plate (130) may be attached to the applicator housing (40) at openings (70; see FIGS. 6–7, 11A–B, 12A–C and 13). Fasteners (150; see FIGS. 8 and 13) together with suitable retainers, such as nuts (155, 157) and washer (158) may be used with each attachment opening (120, 125) for connecting the applicator housing (40) to the mounting bracket. The openings (120, 125) in the top and bottom of the housing, and the opening (140) in the reinforcement plate (130), are each of a sufficient size to permit at least partial lateral movement of the fastener (150) within each opening to permit use of mounting brackets of varying size and to adjust the position of the applicator when in use. For example, once the housing (40) is connected to the undercarriage of a railcar, its position relative to a rail car wheel can be adjusted by sliding the housing relative to the mounting bracket to bring a surface of the solid composition stick (90) protruding from the housing, in contact with the flange of the rail car wheel (see FIG. 14).

The applicator housing (40) includes an inlet (160) and an outlet (170) in communication with the conduit (80). The applicators shown in FIGS. 2–7, 9, 11A–B, 12A–C and 13 define an arc of about 270° extending from the inlet (160), along the conduit (80), to the outlet (170). However, other lengths of circumference, or arc, of the conduit may also be used for example, but not limited to, an applicator defining an arc from about 180° to about 320°, an arc from about 185° to about 300°, or an arc from about 220° to 280°. If the arc is too small (i.e. less than about 180°), then there may be insufficient reservoir space within the conduit to contain an adequate amount of the composition stick. This would require more frequent refilling of the applicator. However, for some uses an applicator comprising a conduit describing an arc of less than 180° may be suitable, for example for treating fifth wheel surfaces, guide rails in elevators, or closed loop rail-transit systems. In situations where longer periods of use are desired between refilling the applicator, a longer length of arc may be required, so that the conduit reservoir is larger and houses more composition sticks. The length of arc of the conduit in these circumstances may exceed 320°, and will be limited by the size of the opening required between the inlet (160) and the outlet (170). This opening size may be limited by the thickness of steel surface to be treated, and the size of the composition stick (90) to be inserted within the applicator.

By increasing the length of the arc-shaped conduit, either by increasing the circumference to for example about 260°, 280°, 300°, or 320°, or by increasing the diameter of the housing, more composition stick can be introduced into the applicator per loading, thereby reducing the frequency of refilling the applicator.

As shown in FIG. 2, a guide track (180) may be present on the inside of the upper section (50). Alternatively, the guide track may be present on the inside of the lower section (60), or the inside of both the upper and lower sections (50, 60), for mating engagement with a channel on the composition stick (90). This feature may be used to ensure that an interlocking solid composition stick (90) is inserted into the applicator housing in an orientation that will allow it to properly interconnect with other segments preceding or following it.

Figure 3A:
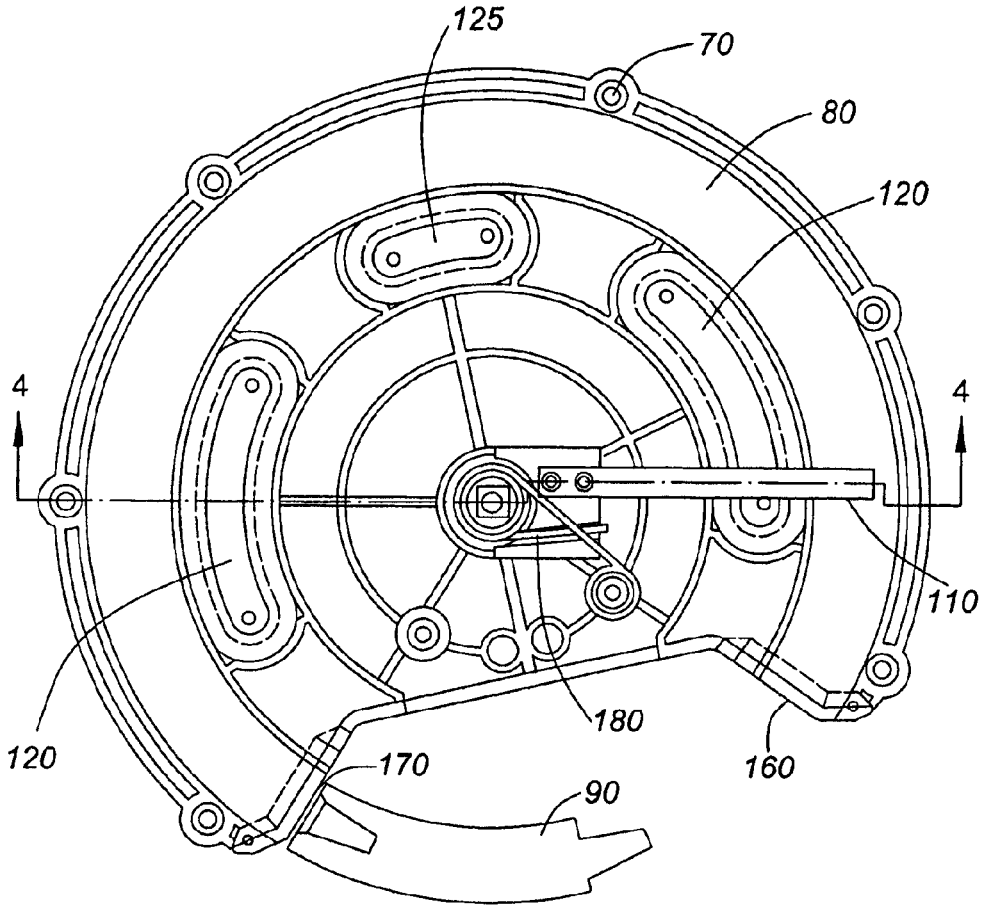
FIG. 3A shows a plan view of the housing of FIG. 2 including a composition stick.
Figure 3B:
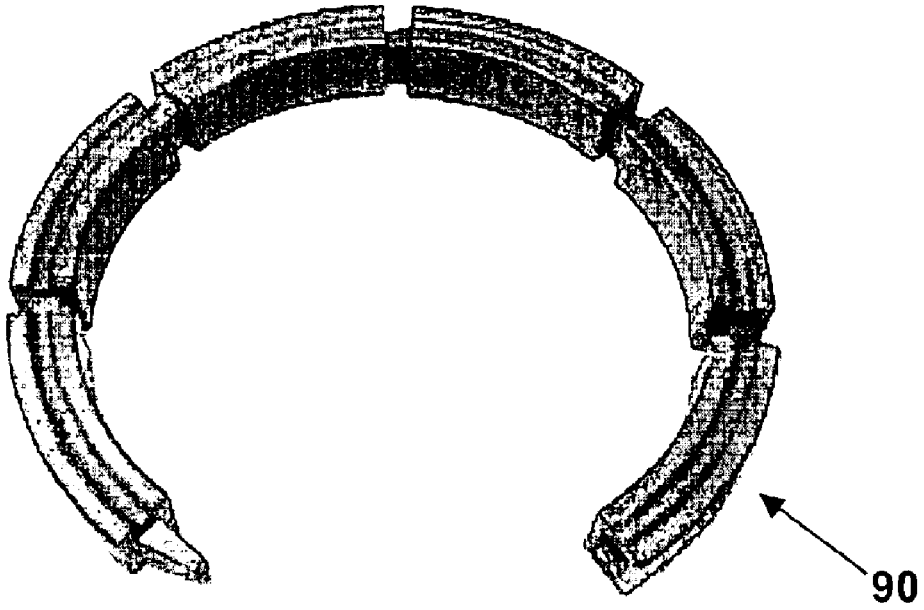
FIG. 3B shows a set of six interlocking compositions sticks that may be used with the applicator of the present invention.
Figure 3D:
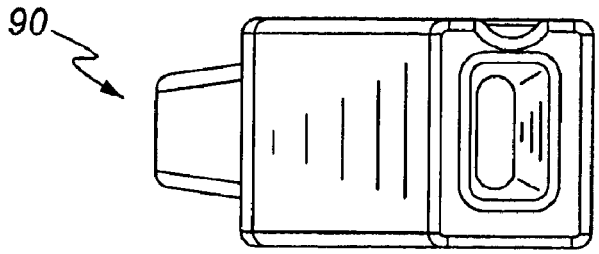
FIGS. 3D–3F show different perspective views of the composition stick of FIG. 3C.
Figure 3E:
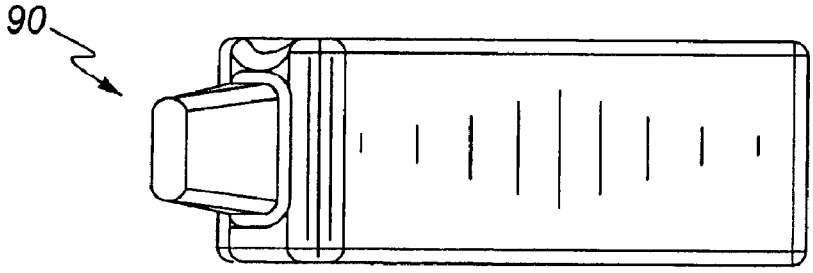
Figure 3C:
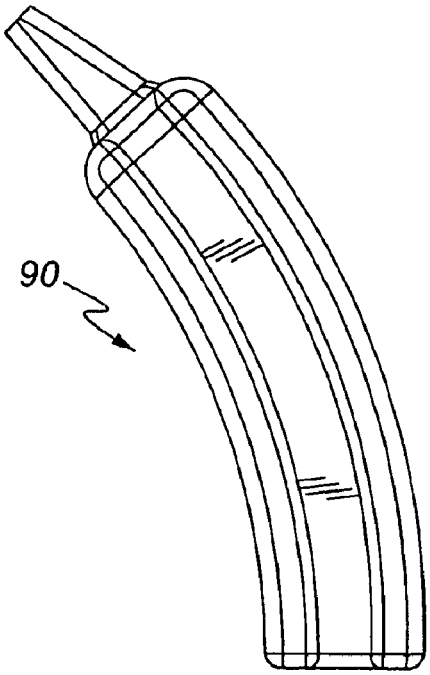
FIG. 3C shows a top plan view of one of the composition sticks of FIG. 3B.
Figure 3F:
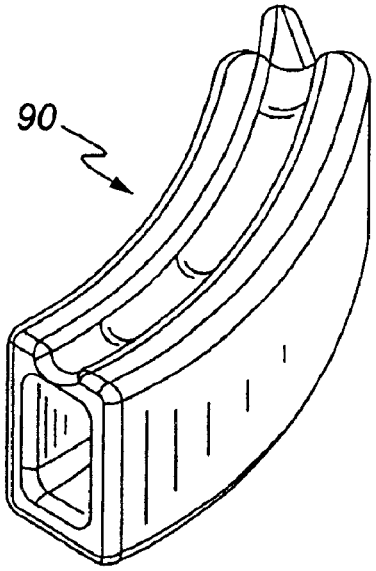
Figure 10A:
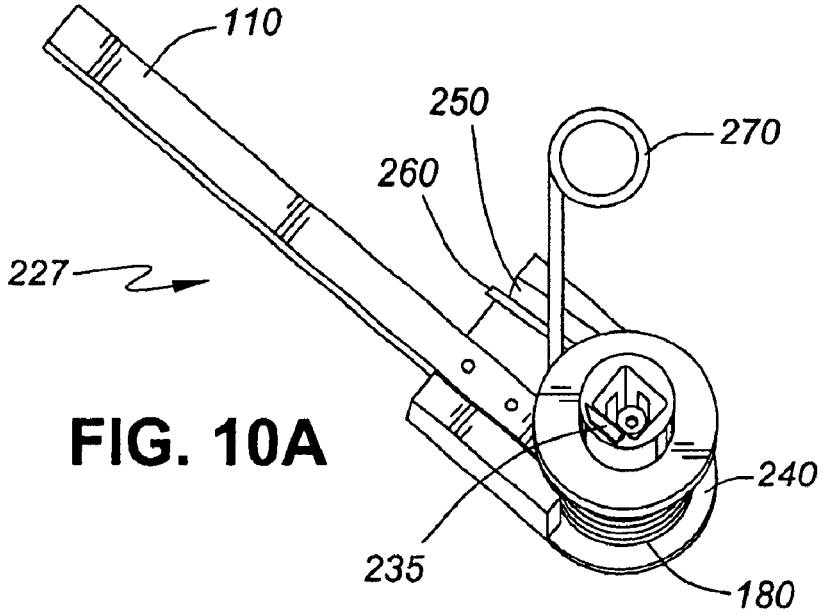
FIG. 10A shows a perspective view of an example of the biasing assembly of the present invention.
Figure 10B:
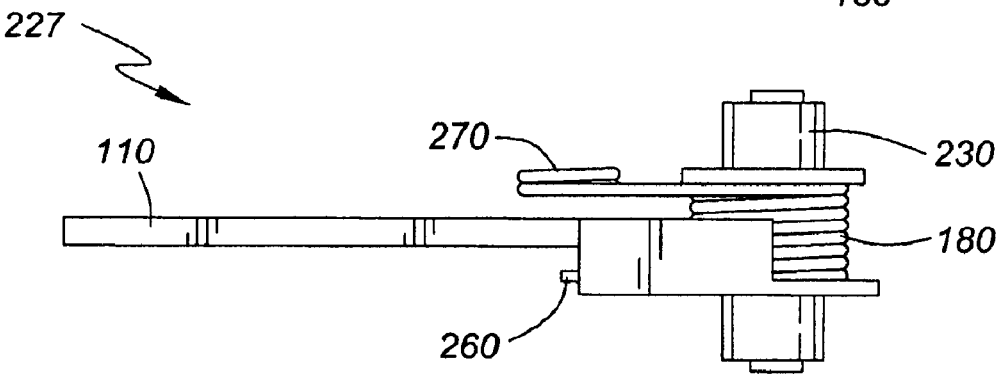
FIG. 10B shows a side elevational view of the biasing assembly of FIG. 10A.
Figure 10C:
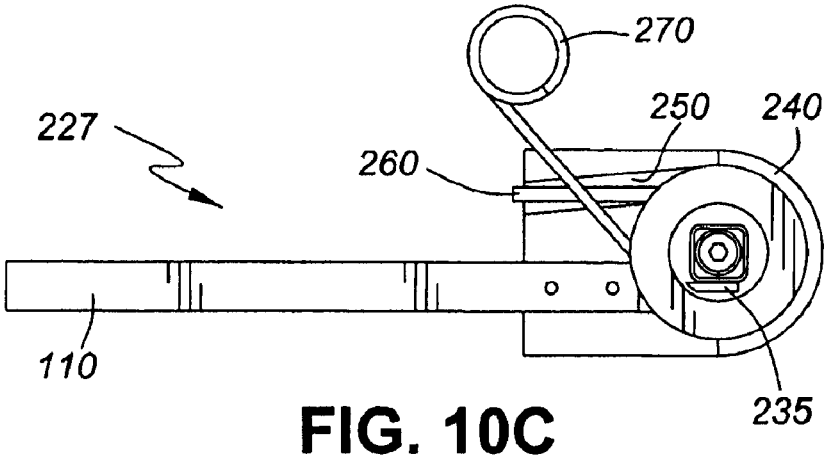
FIG. 10C shows a top plan view of the biasing assembly of FIG. 10A.
Figure 11A:
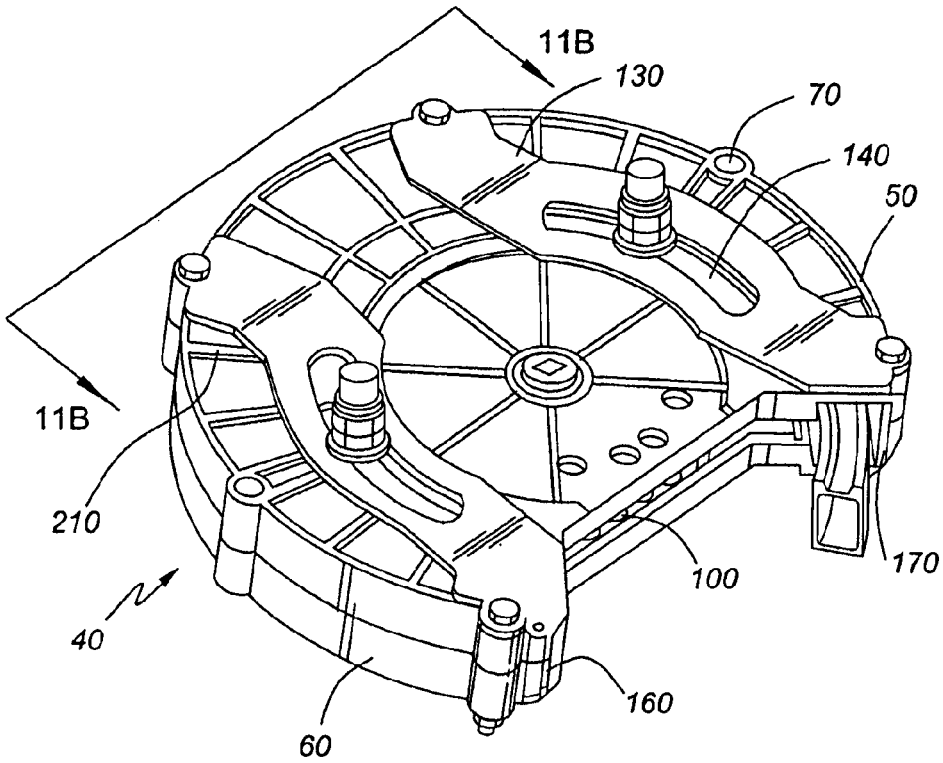
FIG. 11A shows a perspective view of a further example of the applicator of the present invention.
Figure 11B:
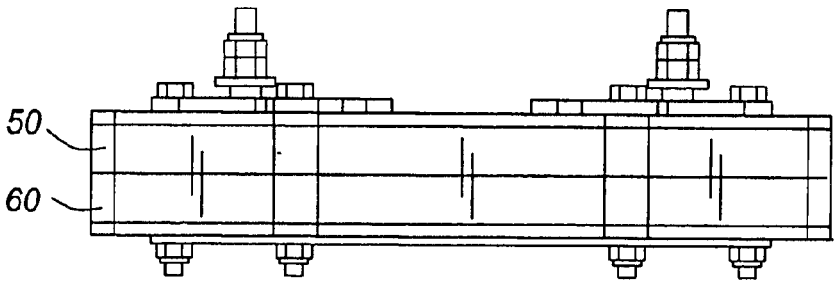
FIG. 11B shows an elevational view in the direction of line 11B—11B of FIG. 11A.
Figure 12A:
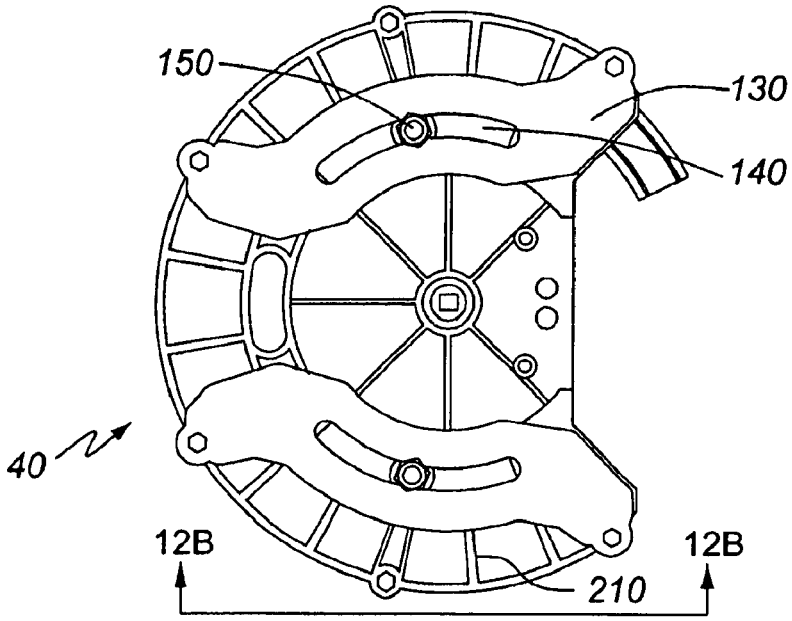
FIG. 12A shows a top plan view of the applicator of FIG. 11A.
Figure 12B:
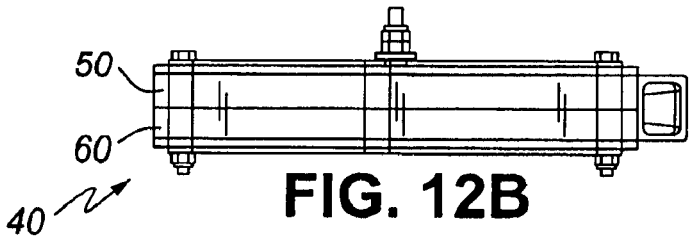
FIG. 12B shows a side elevational view in the direction of line 12B—12B of FIG. 12A.
Figure 12C:
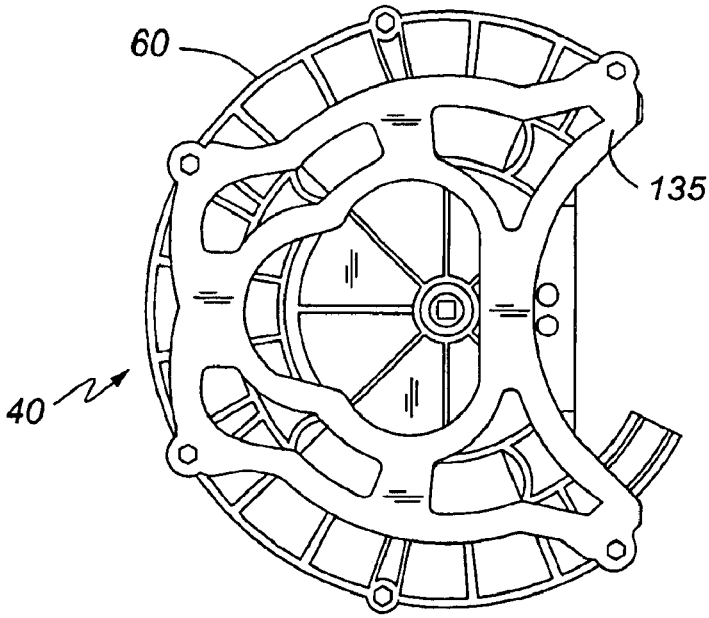
FIG. 12C shows a bottom plan view of the applicator of FIG. 11A.

The applicator housing (40) also includes a biasing assembly (227) comprising a biasing element (180) and a contact stick (110), as illustrated in FIGS. 3A, 4, 10A–C and 13). The biasing element (180) advances contact stick (110) through the conduit (80) and ensures that the contact stick (110) presses against and pushes the composition stick (90; FIGS. 3A and B) through the conduit (80). The contact stick (110) also ensures contact of the composition stick (90) with a surface to be treated, for example, but not limited to the flange of a rail car wheel (e.g. FIG. 14). The biasing assembly also comprises a hub (240) having a spindle (230), as seen in FIGS. 10A–C. Hub (240) comprises a channel (250) for accommodating and securing a straight end (260) of biasing element (180). Securement of straight end (260) within channel (250) retains spring assembly (180) in place around spindle (230). Biasing element (180) also has an end loop portion (270) for connecting to a bearing (280) that surrounds a bolt (290) secured near the front of passageway (100), as illustrated in FIG. 13. The contact stick (110) is disposed within, and may extend through, passageway (100), and into conduit (80). The spindle (230) is pivotally attached to the applicator housing (40) using, for example, bushings (190, 200). Although the contact stick (110) and the hub (240) are shown as separate components, they can be fabricated as a single unit.

The contact stick (110), connected through hub (240) to the biasing member (180), for example but not limited to, a spring loader assembly, is moveable through an area contained within the passageway (100) and the conduit (80). It is preferred that the biasing element (180) be made of a material that is lightweight and strong. Non-limiting examples of such a material include aluminum, high density polyethylene (HDPE), nylon, steel and fiber-reinforced plastic. It is particularly preferred that the biasing member (180), if it is a spring, be made of anodized aluminum to improve wear.

To load the applicator, the spindle (230) can be wound back to retract the biasing member (180) and move the contact stick (110) out of the passageway (100) until one, or more than one composition stick (90) has sufficient space to enter into inlet (160). Alternatively, the composition sticks may be fed through the outlet (170) and push the contact stick back along the passageway (100). The outlet (170) of the applicator (40) is then brought in close proximity to the steel surface to be treated, for example, but not limited to a flange of a rail car wheel (see FIG. 14). The contact stick (110) is then brought into contact with a surface of the composition stick (90) biasing an end of the one, or more than one composition stick (90) to engage the steel surface. Therefore, the applicator as described herein may be easily refilled. The applicator may be refilled by inserting one or more than one arc-shaped composition stick through the outlet of the conduit, in a process that does not require disassembly of the applicator housing.

In another example, the biasing assembly may comprise a leaf spring biasing member, comprising for example, spring steel that is fitted alongside the passageway (100) and extending from the outlet (170) to the inlet (160). One end of the leaf spring biasing member is in communication with a contact member (not shown), so that the contact member engages a surface of the composition stick (90). The other end of the leaf spring biasing member is anchored at one or both of the upper section (50) and lower section (60) at the outlet (170). In this example, the applicator (40) may be loaded by extending the biasing assembly along passageway (100) from the outlet (170) to a position at or near the inlet (160). A stop member (not shown) may be used to hold the biasing assembly in place. The interlocking, segmented solid composition sticks (90) can then introduced through outlet (170). Alternatively, the composition sticks may be feed through the outlet (170) and push the contact member and leaf-spring biasing member back along the passageway (100), and if desired the stop member engaged. Outlet (170) of the applicator (40) may then be brought in close proximity to the flange of a steel surface to be treated, for example a rail car wheel. The stop member is then released, and the contact member is forced against the composition stick by the action of the biasing member forcing an end of the composition stick to engage the steel surface.

In other examples, the arc-shaped composition stick is loaded through openings present in the top, bottom or side of the housing.

Therefore, the present invention provides an applicator for an arc-shaped solid composition stick, comprising:

a housing defining an arc-shaped conduit, the arc-shaped conduit sized to accept the arc-shaped solid composition stick, the housing comprising:

one, or more than one opening for engaging a fastener, the one, or more than one opening being of a sufficient size to permit at least partial lateral movement of the fastener;

an inlet and an outlet, the inlet and the outlet in communication with the conduit, and a biasing assembly for advancing the arc-shaped solid composition stick within the arc-shaped conduit.

The present invention also relates to the applicator described above in combination with the arc-shaped solid composition stick.

If desired, an indicator, for example an arrow (235) that points in the direction of the longitudinal axis of the contact stick, may be molded into the top of spindle (230) to indicate the position of the contact stick (110) within passageway (100). This indicator will rotate with the contact stick as the one, or more than one composition stick reduce in size during use. However, other methods for indicating the position of the contact stick (110) or composition stick may be used, including, for example, visual inspection through openings, for example, attachment openings (120, 125).

Figure 5:
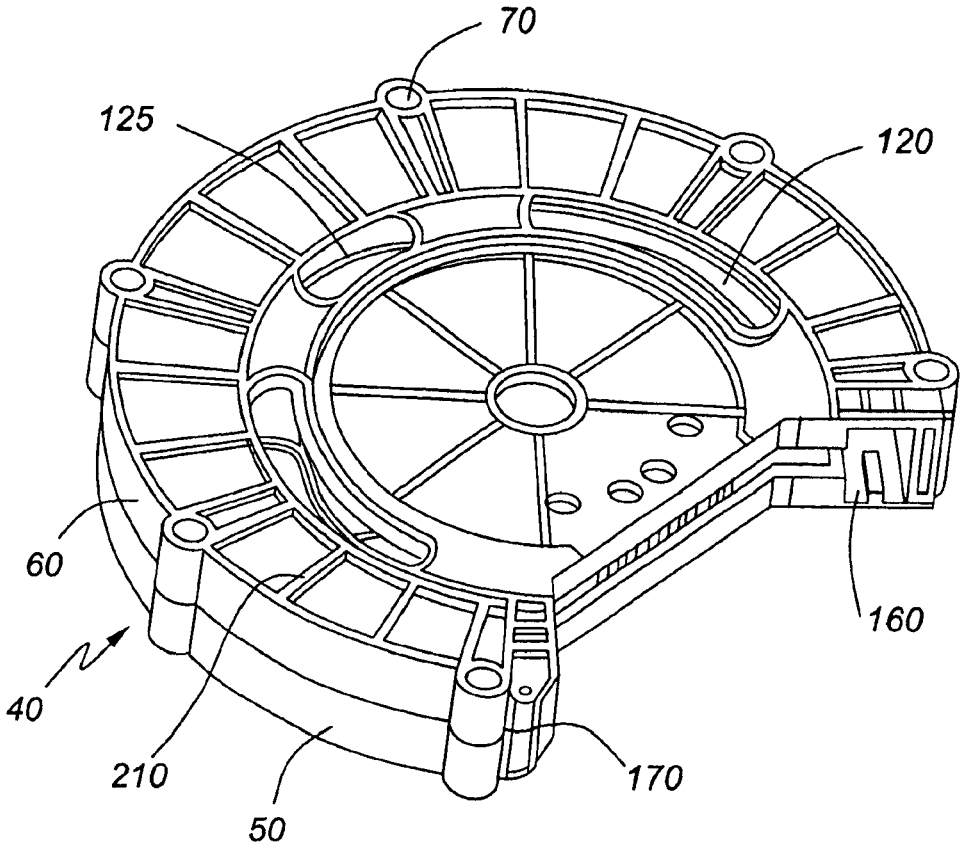
FIG. 5 shows a perspective view of another example the applicator of the present invention.

Referring to FIG. 5, there is shown a variant of the present invention, in which the upper (50), lower (60), or both sections of the housing can include a series of injection-molded ribs (210), which provide strength and durability to the overall structure of the housing. The ribs (210) rigidify the housing, and provide further resistance to vibrations and shocks that may be encountered during use of the applicator (40).

Figure 6:
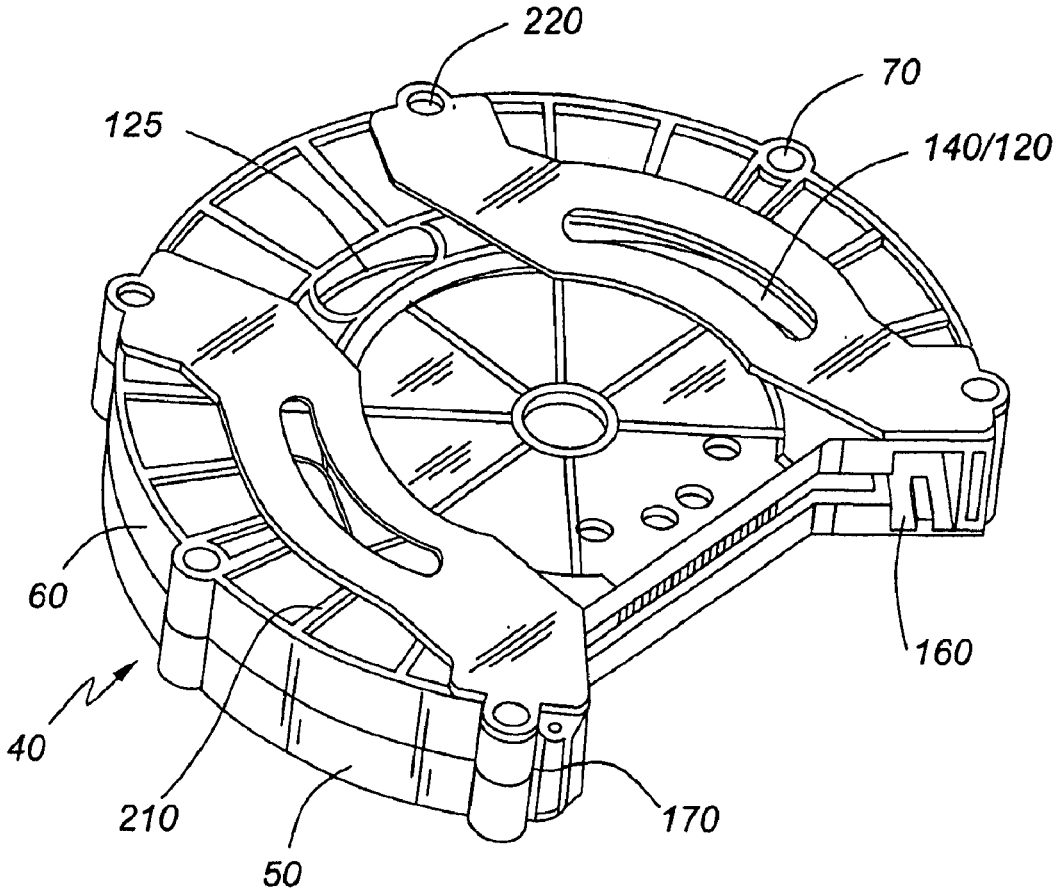
FIG. 6 shows a perspective view of an additional example of the applicator of the present invention.
Figure 7:
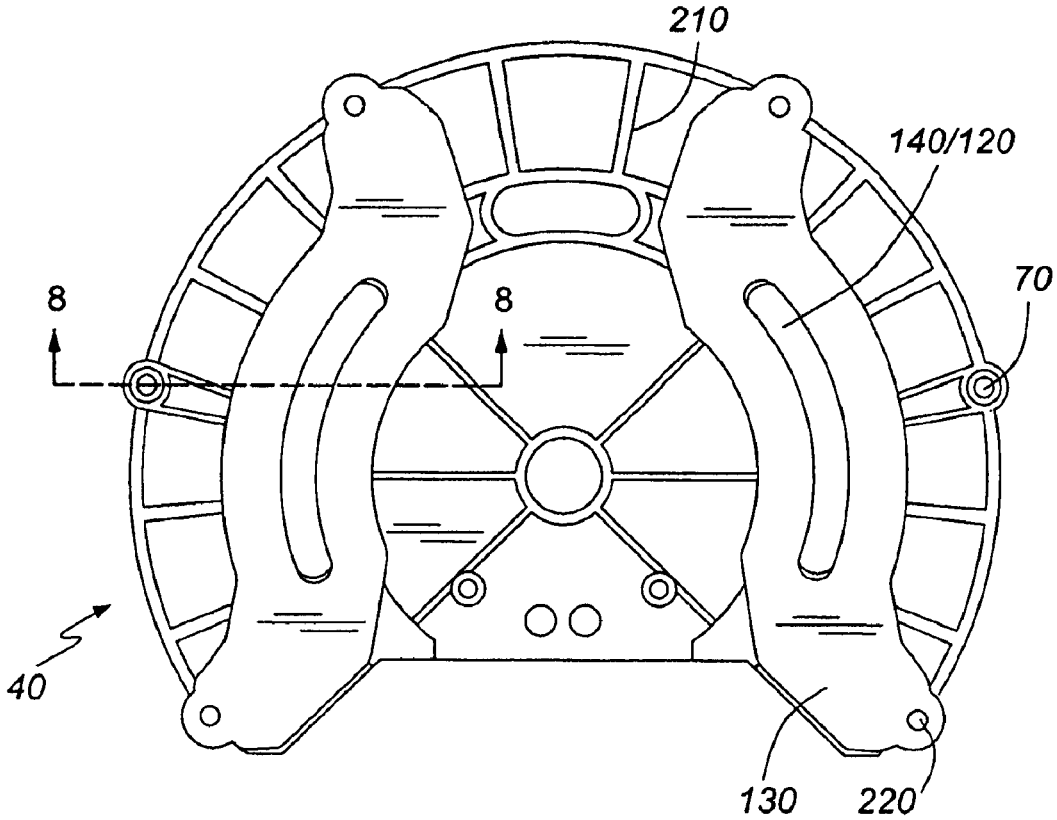
FIG. 7 shows a top plan view of the applicator of FIG. 6.

Referring to FIGS. 6 and 7, there is shown an alternate variant of the applicator (40) of the present invention, in which one, or more than one reinforcement (attachment) plate (130) constructed of, for example, but not limited to, a durable metal, such as steel, or a suitable polymer, are connected to the upper section (50), the lower section (60), or both the upper and lower sections (50, 60). The reinforcement plate (130) has an aperture of similar shape and size (140) as the openings (120), to permit lateral movement of fastener (150, see FIGS. 4 and 8) within the aperture of each of the reinforcement plates (130) when the applicator (40) is mounted, for example, to an undercarriage of a rail car, permitting, if required, repositioning of the applicator. The plate (130) can also have one or more than one hole (220) at either end, for accommodating a fastener, such as a bolt, to secure the plate to the upper section (50), the lower section (60), or both the upper and lower sections (50, 60). However, any other means of attachment may be used to secure the plate to the upper, lower, or both housings. Two reinforcement plates may be used to cover both sides of the upper section (50), the lower section (60), or both sections (50, 60), or a single large reinforcement plate (135, FIGS. 12C and 13) may be used. The reinforcement plates reinforce the applicator as well as re-distribute and reduce the bending forces on the applicator under vibration.

Figure 8:
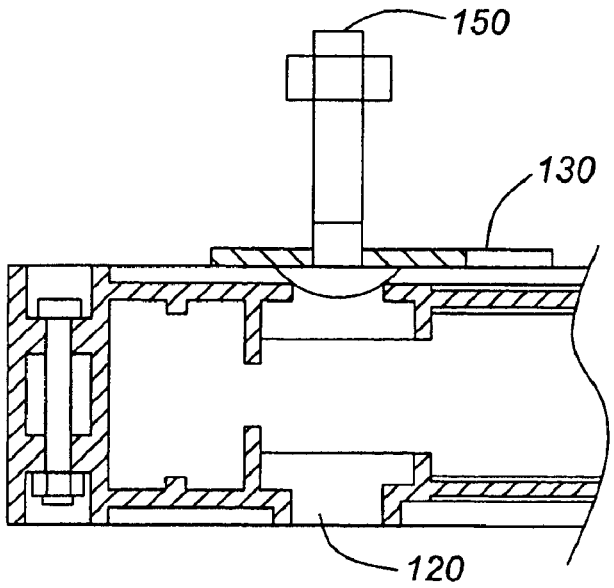
FIG. 8 shows a partial cross sectional view along line 8—8 in FIG. 7.

Referring to FIG. 8, there is shown a cross-section of the applicator (40) shown in FIG. 7, which illustrates how the fastener (150) may be positioned relative to a reinforcement plate (130) and the upper section (50) or the lower section (60).

Figure 9:
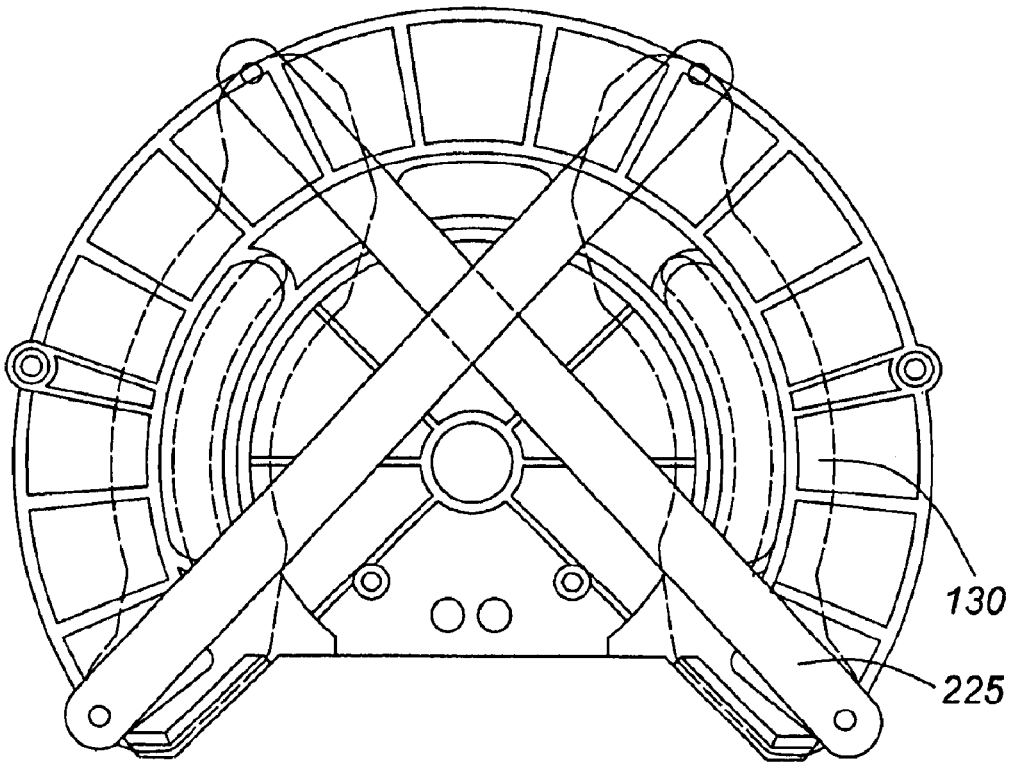
FIG. 9 shows a bottom plan view of an example of the applicator of the present invention.

Additional reinforcement may be provided by additional reinforcement brackets, for example, but not limited to the brackets (225) shown in FIG. 9, mounted on the upper section (50), the lower section (60) or both sections. These reinforcement brackets may also be combined with reinforcement plates (130). The brackets are preferably constructed of a strong durable material for example steel or suitable polymer.

It is preferred that the applicator be fabricated of a light weight material, so that it does not cause excessive loading on the undercarriage of the rail car that supports it. An example of a material that can be used in the formation of the applicator of the present invention, includes, without limitation, a steel, for example aluminum, or a polymer having a tensile strength of at least about 4500 psi, or a compression strength of at least about 500 psi, or both, for example, but not limited to, high density polyethylene, HDPE, nylon or other material. If required, the outlet (170) of the applicator (40) may be reinforced, to provide additional support for the portion of the composition stick that contacts the steel surface, as this region may be subjected to high vibrations. Such reinforcement may include increased thickness of the housing material, or the addition of a reinforcing band of material, for example an aluminum band that may be fastened to the housing at or near the outlet.

The rugged design of the applicator of the present invention allows it to be used in environments where dusty, oily, harsh vibration or severe shock conditions, and changes in temperature are encountered.

The above description is not intended to limit the claimed invention in any manner, furthermore, the discussed combination of features might not be absolutely necessary for the inventive solution.

The present invention will be further illustrated in the following examples. However it is to be understood that these examples are for illustrative purposes only, and should not to be used to limit the scope of the present invention in any manner.

EXAMPLE

The applicators of the present invention were subjected to testing to determine their suitability under standard conditions of random vibration levels (Long Life Test), and their resistance to shock (Shock Test). Both tests were performed in the vertical direction and were conducted in accordance to the procedures of IEC specification 61373.

In the long life test, the applicators of the present invention were subjected to an equivalence of 34.6 hours of vibration at a level of 42.5 m/s2 RMS from 5 to 250 Hz. For bogie mounted equipment, the IEC 61 373 specification specifies a 5 hour duration at this vibration level to represent a field life of 6.25 years based on 300 days of service per year and 10 hours of service per day. There was no indication of fatigue failure or loss of integrity to any of the applicators after this test.

After the conclusion of the long life test at increased random vibration levels, the ability of the applicators of the present invention to withstand shocks was tested. The shock test was performed using a 30 G half sine pulse with a pulse duration of 11 milliseconds. All applicators were subjected to 10 negative pulses and 3,310 positive pulses in the vertical direction. The time between pulses was set at 1 second. For bogie-mounted equipment, the IEC 61 373 specification specifies 3 pulses in both the positive and negative directions with a half sine pulse of 30.6 G at a duration of 18 milliseconds. There was no indication of failure or loss of integrity to any of the applicators after this test even though the test severity greatly exceeded the IEC 61373 specifications.

Test Specifications and Procedures

The vibration tests were conducted at the National Research Council of Canada, Centre for Surface Transportation Technology test lab in Dartmouth, Nova Scotia, Canada. NRC, using IEC 61373: 1999 (Simulated Long Life Testing at Increased Random Vibration Levels: Section 9) and IEC 61373: 1999 (Shock Testing Conditions: Section 10). The Shock and Vibration Equipment included a LDS (Ling Dynamic Systems), Shock and Vibration Table Model: V894 1220C.

The instrumentation and control equipment used for the tests were as follows:

Control System: Spectral Dynamics Vibration Control System Model:2252-9704-1
Control Accelerometer: PCB
Model: 302A02 Serial: 16914
Response Accelerometers: PCB
Model: 353B15 Serial: 64746
Model: 353B15 Serial: 64747
Model: 353B16 Serial: 64983
Model: 353B16 Serial: 64984

Four solid applicators were tested.

Model #1: PA073L0000; HDPE applicator—no ribs; (FIG. 2)
Model #2: PA073L0000/I; ribbed applicator made from HDPE; (FIG. 5)
Model #3: PA073L0000/I; ribbed applicator made from HDPE with Attachment Plates; (FIG. 6)
Model #4: PA073L0000/I; ribbed applicator made from Nylon; (FIG. 5)

A custom designed fixture for the shaker table was prepared comprising the brackets used to mount the applicator as used in the field. The fixture was designed to hold four applicators so that the vibration test was conducted on all applicators at the same time. This design ensured that all applicators would be exposed to the same vibration severity levels and for the same period of time prior to any possible occurrence of failures. The base of the fixture was designed to match the holes on the base of the vibration table.

The applicators were set up on the fixture, and the control accelerometer was attached to the base plate of the fixture. A response accelerometer was attached to each of the applicators by the outlet (170) where the composition stick meets the wheel flange. Each applicator was loaded with 6 interlocking composition sticks (90). Simulation of composition stick contact with the wheel flange was done during the tests. A restraining structure was designed to simulate the wheel flange surface. The restraining structure for each applicator was fixed outside of the shaker table and applicator fixture; this was to approximate the independent motions of the bogie frame, to which the applicators are mounted, and the wheel flange.

Sine Sweep Test

A sine sweep was performed on the applicators to determine whether there were any natural resonance frequencies in the frequency spectrum of interest. The sweep was from 5 to 250 Hz at 0.5 G, at a sweep rate was at one octave per minute. For each applicator, the response as well as the Q factor (response vs. control ratio) were measured. The testing showed that there were no significant resonances, especially in the 10 to 100 Hz range where higher acceleration occurs. For the Model #1, there was a small broadband resonance below 100 Hz that was not observed in the other three designs. The applicator showing the least amount of response in the 10 to 100 Hz range was Model #2. Models #3 and #4 had similar responses.

Simulated Long Life testing at Increased Random Vibration Levels (Response of applicator at the various vibrational severity levels). For this test, the initial vibration level was set at 8.32 m/s2 RMS. This value was calculated from a fatigue damage equation and the field vibration levels defined in IEC specification 61373. The power factor "m" was set at 15 (a value used in vibration testing of plastic automotive parts). As defined by the IEC specification, the ASD spectrum for bogie-mounted equipment is from 5 to 250 Hz. In the 5 to 10 Hz range, there is an acceleration rise of 9 db per octave. In the 100 to 250 Hz range, there is an acceleration drop of 6 db per octave.

During the test the applicators were visually inspected for cracks and signs of fatigue failure. Due to the logarithmic nature of the SN curve, a logarithmic inspection of the applicators was conducted. At every new vibration level applied, the applicators were inspected after 1, 2, 4, 8, 16, and 30 minutes of vibration testing. If the test at one vibration level exceeded one hour, the inspection intervals remained at 30 minutes thereafter.

No signs of cracks or fatigue failure were noticed during the test. Table 1 summarizes, in chronological order, the vibration levels and durations of the random vibration test over a 3-day testing period.

TABLE 1

Random Vibration Test Runs

| Vibration Run | Vibration Level ($m/s^2$ RMS) | Duration (Minutes) |
|---|---|---|
| 1 | 8.32 | 194 |
| 2 | 16.64 | 123 |
| 3 | 25.0 | 120 |
| 4 | 33.5 | 60 |
| 5 | 42.5 | 60 |
| 6 | 50.0 | 60 |
| 7 | 60.0 | 120 |
| 8 | 65.0 | 122 |
| 9 | 60.0 | 180 |

At the end of each vibration run, the applicators were visually inspected for cracks and damage. There were no indications of failure or loss of integrity on any of the applicators. The results of this test showed there were no significant resonances, especially in the 10 to 100 Hz range. The Model #1 design was more responsive than the other applicators from approximately 50 to 100 Hz. Summing the nine vibration runs using the power factor (m) of 4, the applicators were subjected to an equivalent of 34.6 hours of vibration at a level of 42.5 $m/s^2$ RMS from 5 to 250 Hz. For bogie mounted equipment, the IEC 61373 specification specifies a 5 hour duration at this vibration level to represent a field life of 6.25 years based on 300 days of service per year and 10 hours of service per day. The applicators endured nearly 7 times the vibration duration specified in the IEC specification.

Shock Test

A shock test was conducted to evaluate the ability of the different applicator designs of the present application to withstand shocks in the vertical direction. The shock test was performed using a 30 G half sine pulse with a pulse duration of 11 milliseconds. The IEC 61373 specification specifies a half sine pulse of 30.6 G and a duration of 18 milliseconds. However, the LDS system could not achieve the 18 millisecond duration due to the mass of the fixture and applicators. The pulse level on the existing set-up was, therefore used, since multiple pulses could be achieved in a relatively short time. The time between pulses was set at 1 second.

Initially, all applicators were subjected to 10 pulses both in the positive and negative directions. The responses were very similar in nature therefore, only pulses in the positive direction would be applied. For bogie-mounted equipment, the IEC 61 373 specification specifies 3 pulses in both the positive and negative directions to be applied.

An additional 3,300 pulses were then applied to the applicators. Inspections were made after every 500 pulses. There was no indication of failure or loss of integrity to any of the Circ III applicators after this test.

Model #1 was more susceptible to shock than the others, where for very small time durations, response peaks reached as high as 150 G. Model #4 (ribbed and made from Nylon) was the least susceptible to shock. No response peak from this applicator reached beyond 50 G.

All citations are herein incorporated by reference.

The present invention has been described with regard to preferred embodiments. However, it will be obvious to persons skilled in the art that a number of variations and modifications can be made without departing from the scope of the invention as described herein.

The embodiments of the invention in which an exclusive property or privilege is claimed are defined as follows:

1. An applicator for a circular arc-shaped solid composition stick, comprising:

a housing defining a conduit having a first end and a second end, the second end being open, the conduit having a continuous circular arc-shape from the first end to the second end, and the conduit sized to accept the circular arc-shaped solid composition stick, the housing comprising:

one, or more than one opening for engaging a fastener, the one, or more than one opening being of a sufficient size to permit at least partial lateral movement of the fastener;

an inlet and an outlet, the inlet and the outlet sized to accent the circular arc-shaped solid composition stick and in communication with the conduit, the outlet in communication with the second end, and a biasing assembly for advancing the circular arc-shaped solid composition stick within the conduit, wherein activation of the biasing assembly advances the circular arc-shaped solid composition stick through the conduit, the second end of the conduit, and the outlet of the applicator.

2. The applicator of claim 1, wherein the housing further comprises one, or more than one radially extending rib.

3. The applicator of claim 1, further comprising the circular arc-shaped solid composition stick.

4. The applicator of claim 3, wherein the biasing assembly comprises a biasing element and a contact member, wherein the biasing element biases the contact member against the circular arc-shaped solid composition stick.

5. The applicator of claim 4, wherein the biasing element is a spring assembly.

6. The applicator of claim 5, wherein the contact member is a contact stick, the contact stick in operative association with the spring assembly, and pivotally connected to the applicator housing, the contact stick moveable through an area contained within the conduit.

7. The applicator of claim 4, further comprising one, or more than one radially extending rib.

8. The applicator of claim 3, wherein the circular arc-shaped solid composition stick comprises one, or more than one interlocked segments.

9. The applicator of claim 3, wherein the circular arc-shaped solid composition stick is a circular arc-shaped solid lubricant stick.

10. The applicator of claim 1, wherein the housing is fabricated from a polymer having a tensile strength of at least about 4500 psi, a compression strength of at least about 500 psi, or both.

11. The applicator of claim 1, wherein the housing is made of high density polyethylene (HDPE), Nylon®, steel or fiber reinforced plastic (FRP).

12. The applicator of claim 1, wherein the housing is made of aluminum.

13. The applicator of claim 1, wherein the applicator is refillable.

14. The applicator of claim 1, wherein the biasing assembly comprises a biasing element and a contact member, wherein the biasing element biases the contact member against the circular arc-shaped solid composition stick.

15. The applicator of claim 14, wherein the biasing element is a spring assembly.

16. The applicator of claim 15, wherein the contact member is a contact stick, the contact stick in operative association with the spring assembly, and pivotally connected to the applicator housing, the contact stick moveable through an area contained within the conduit.

17. The applicator of claim 1, wherein the conduit comprises a continuous outer wall, a continuous top wall, a continuous bottom wall, a flange extending from the inner edge of the top wall, and a flange extending from the inner edge of the bottom wall.

18. The applicator of claim 1, further comprising one, or more than one attachment plate attached to the top, bottom, or both the top and bottom of the housing.

19. The applicator of claim 1, wherein the housing comprises an upper and a lower section, the upper section, the lower section, or both the upper and lower sections comprising one, or more than one opening for inserting a fastener for installing the applicator while in use, the one, or more than one opening being of a sufficient size to permit at least partial lateral movement of the fastener within the opening.

20. The applicator of claim 19, further comprising one or more than one attachment plate attached to the upper section, the lower section, or both the upper and lower sections.

21. The applicator of claim 1, wherein the arc shaped conduit has a circumference of about 185° to about 300°.

22. An applicator for a circular arc-shaped solid composition stick, comprising:

a housing, the housing defining a conduit having a first end and a second end, the second end being open, the conduit having a continuous circular arc-shape from the first end to the second end, the conduit sized to accent the circular arc-shaped composition stick, the housing comprising:

an upper and a lower section, the upper section, the lower section, or both the upper and lower sections comprising one, or more than one opening for engaging a fastener, the one, or more than one opening being of a sufficient size to permit at least partial lateral movement of the fastener, the upper section, the lower section or both the upper and lower sections further comprising one, or more than one radially extending rib;

a biasing assembly for advancing the circular arc-shaped solid composition stick within the conduit, the biasing assembly comprising a spring assembly and a contact stick, the spring assembly biasing the contact stick against the circular arc-shaped solid composition stick, the contact stick pivotally connected to the housing, and moveable through an area contained within the conduit, and an inlet and an outlet, the inlet and the outlet sized to accent the circular arc-shaped solid composition stick and in communication with the conduit, the outlet in communication with the second end, wherein activation of the biasing assembly advances the circular arc-shaped solid composition stick through the conduit, the second end of the conduit, and the outlet of the applicator.

23. The applicator of claim 22, wherein the housing is fabricated from a polymer having a tensile strength of at least about 4500 psi, a compression strength of at least about 500 psi, or both.

24. The applicator of claim 22, wherein the housing is made of high density polyethylene (HDPE), Nylon®, steel or a fiber reinforced plastic (FRP).

25. The applicator of claim 22, wherein the housing is made of aluminum.

26. The applicator of claim 22, further comprising the arc-shaped solid composition stick.

27. The applicator of claim 26, wherein the circular arc-shaped solid composition stick comprises one, or more than one interlocked segments.

28. The applicator of claim 22, wherein the first end is open, and the inlet is in communication with the first end.

29. The applicator of claim 1, wherein the first end is open, and the inlet is in communication with the first end.

* * * * *

UNITED STATES PATENT AND TRADEMARK OFFICE

CERTIFICATE OF CORRECTION

PATENT NO. : 6,854,908 B2
DATED : February 15, 2005
INVENTOR(S) : Hui et al.

It is certified that error appears in the above-identified patent and that said Letters Patent is hereby corrected as shown below:

Drawings,
Sheet 14, delete and insert the drawing attached.

Signed and Sealed this

Thirteenth Day of June, 2006

JON W. DUDAS
*Director of the United States Patent and Trademark Office*